US006214532B1

(12) United States Patent
Bollen

(10) Patent No.: US 6,214,532 B1
(45) Date of Patent: Apr. 10, 2001

(54) METHOD OF PREPARING SILVER HALIDE EMULSION CONTAINING HOMOGENEOUS AND THIN TABULAR CRYSTALS

(75) Inventor: Dirk Bollen, Sint Truiden (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/460,377

(22) Filed: Dec. 13, 1999

Related U.S. Application Data

(60) Provisional application No. 60/122,384, filed on Mar. 2, 1999.

(30) Foreign Application Priority Data

Dec. 21, 1998 (EP) ..... 98204367

(51) Int. Cl.[7] ..... G03C 1/005; G03C 1/494
(52) U.S. Cl. ..... 430/569; 430/567
(58) Field of Search ..... 430/567, 569

(56) References Cited

U.S. PATENT DOCUMENTS

| | | | | |
|---|---|---|---|---|
| 5,145,768 | | 9/1992 | Ichikawa et al. . | |
| 5,238,805 | * | 8/1993 | Saitou | 430/569 |
| 5,270,159 | | 12/1993 | Ichikawa et al. . | |
| 5,380,641 | * | 1/1995 | Urabe et al. | 430/569 |
| 5,733,715 | * | 3/1998 | Verbeeck et al. | 430/569 |
| 5,985,535 | * | 11/1999 | Urabe | 430/569 |

FOREIGN PATENT DOCUMENTS

| | | |
|---|---|---|
| 0 102 320 | 3/1984 | (EP) . |
| 0 697 618 | 2/1996 | (EP) . |
| 0 816 911 | 1/1998 | (EP) . |

OTHER PUBLICATIONS

Research Disclosure—"Low Silver Halide Concentration Process", vol. 340, No. 37, Aug. 1992, pp. 612–615, XP000328072.

* cited by examiner

*Primary Examiner*—Geraldine Letscher
(74) *Attorney, Agent, or Firm*—Breiner & Breiner

(57) ABSTRACT

Method of preparing a photosensitive element containing a silver halide emulsion with homogeneous and thin tabular crystals, comprising the steps of:

Figure 1:
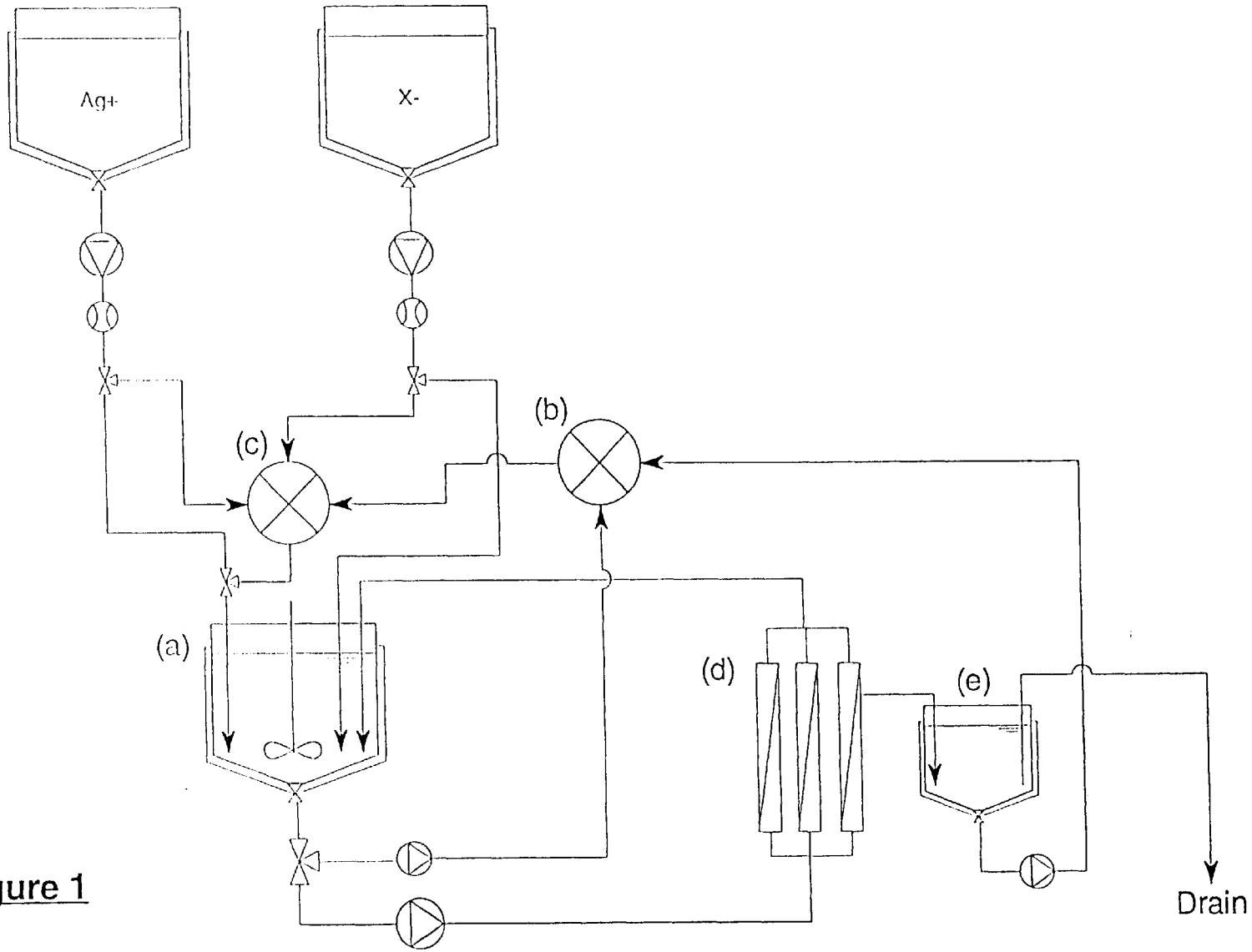

(1) forming silver halide nuclei by simultaneously adding an aqueous silver salt and a halide salt solution to a reaction vessel (a), containing an aqueous solution of a protective colloid, (2) transfering the dispersion of silver halide nuclei formed in vessel (a) to a mixing chaiber (b) and diluting said dispersion, (3) growing in a growth chamber (c) said nuclei of the diluted dispersion by adding and mixing an aqueous silver salt and a halide salt solution and collecting the grown crystals in reaction vessel (a) which is a part of a closed circuitry together with the mixing and growth chambers (b) and (c), (4) transfering said silver halide crystal dispersion to mixing chamber (b) and diluting the dispersion, (5) further growing the silver halide crystals in growth chamber (c) and collecting the silver halide crystals in reaction vessel a), (6) concentrating the emulsion of silver halide crystals simultaneously with the step of growing in order to keep the emulsion level in reaction vessel (a) controlled.

10 Claims, 1 Drawing Sheet

METHOD OF PREPARING SILVER HALIDE EMULSION CONTAINING HOMOGENEOUS AND THIN TABULAR CRYSTALS

This application claims the benefit of U.S. Provisional Application No. 60/122,384 filed Mar. 2, 1999.

FIELD OF THE INVENTION

The present invention relates to a method for controlling several parallel running processes and an apparatus to realize it. More specifically the invention is related to a method for preparing specially designed silver halide crystals which can be used in photosensitive materials.

BACKGROUND OF THE INVENTION

For the formation of inorganic salts a variety of conventional precipitation techniques are known which are mostly always batch-wise processes. This can be easily demonstrated with procedures which are used for the preparation of silver halide salts dispersed in a hydrophilic protective colloid- The most common approach of the batch preparation technique is the single-jet (or single-run) procedure where a silver salt solution is added in a controlled or uncontrolled way into a reaction vessel containing a halide salt. Hereby silver halide nuclei are formed in a first reaction step which is followed by a growth process for the formation of the ultimate silver halide grains. An alternative and more widely used batch process for the formation of silver halide crystals is the double jet precipitation technique whereby a silver salt and a halide salt solution are concurrently added to a reaction vessel containing a dispersing protective colloid. In this process too one can distingish a nucleation and a growth stage which is always undertaken under conditions of rapid stirring of reactants while the volume in the reaction vessel is continuously increasing during the preparation procedure. The double-jet method offers silver halide crystals with narrower grain size distribution and allows free alteration of the halide composition of crystals according to their growth. Double-jet precipitation techniques are described, for example, in U.S. Pat. No. 3,801,326, U.S. Pat. No. 4,046,376, U.S. Pat. No. 4,147,551, and U.S. Pat. No. 4,171,224.

These techniques can be used for the production of many different kinds of crystals having various morphological modifications which can be cubic, tabular, etc in a regular or irregular way. A crystal structure which is increasingly used in photographic industry is the tabular form mainly on account of the increased covering power and further for the increasing surface area of these crystals in respect to their volume. The later aspect has its positive influence on the (spectral) sensitivity which is like the enhanced covering power a very important argument for their use. And next to the existing and ever growing need for more uniform non-tabular crystals in order to get a higher sensitivity and a better granularity and sharpness, the same trend exists for the tabular crystal structure. In the last decade various proposals were filed in many patents which can be divided in different groups on the basis of the used method.

One of the methods starts with the formation of small instable nuclei which are formed in a nucleation chamber outside the precipitation vessel as, for instance, described in JN-A 02.172.815, JN-A 02.172.816 and JN-A 02.172.817. Increased uniformity of crystals can be realized if the nuclei are prepared in a low molecular gelatin (MW<25000) (EP-A 0 610 597) or if the soluble silver and halide salts are mixed together in the nucleation room via a membrane as proposed by Saito (JN-A 05.061.134 and JN-A 06.086.923). Another approach for the preparation of monodisperse tabular crystals uses a modificator added directly after the nucleation phase and adsorbing specifically on (for instance) certain (100- or 111-) lattice sites as described in JN-A 09.218.476 or by Jablonka et al in Chemik.(1998)51(2)44–46. Another method for the preparation of monodisperse tabular crystals was recently described by Larichev et al in Zh.Nauchn. Prikl.Fotogr.,(1996)41(4)1–4. These authors stated that the physical ripening of a fine grain emulsion in the presence of KCNS and at low pBr (of 2–3) gives very uniform tabular crystals by coalescence. The most common method to get a monodisperse tabular crystal population is realized by controlling the pBr during the growth and if desired, the temperature during the physical ripening and growing phase as for instance described in WO92/07295.

But searching for methods to get increased monodispersity raises also the question for a more uniform thickness of the tabular crystals. However this crystal characteristic can be controlled (as explained by Moskinov et al at the IS&T 49$^{th}$ Ann.Conf. (1996)126–128) by the gelatine concentration and the temperature during the nucleation, the pBr during twinning and growth, etc. But particularly if there is a need for thinner tabular crystals the monodispersity will become a problem. Other methods like decreasing the gelatine concentration or using gelatin with lower molecular weight lead to thinner tabular crystals but with loss of uniformity. Further an increased turbulence during precipitation will result in thinner and more uniform crystals but the effect is small and this parameter is a negative factor in scaling-up procedures. It is also possible to interact in the nucleation phase or during the first ripening step in order to get a very thin nucleus as is proposed by Maskasky who uses an amino-pyrimidine grain growth modifier at low pBr and at room temperature in order to get ultra-thin tabular grains (U.S. Pat. No. 5,411,851). But this method is more focused on 'thin' than on 'monodisperse and thin' tabular.

The procedure leading to the needed monodisperse and thin tabular crystal population without the side effects mentioned before is using a (very) low concentration of the reactants during growth which results in an anisotropic growth. This is explained by a mechanism of anisotropic growth which is given by Sugimoto in Phot.Sci.Eng.,28 (1984) 127 and J.Imag.Sci.,33(1989)(6) 203–5 and afterwards further described by Hosoya and Tani (in T.Tani, 'Photographic Sensitivity', Oxford Series nr 8, Oxford University Press, 1995, pag. 39–41). It can be understood that thin tabular crystals formed in this way can be kept homogene if the growth takes place at very low concentration of the silver and halide salt reactants which means that the preparation procedure itself is time-consuming and very inefficient while the emulsion has to be concentrated afterwards. This extra working-step can be carried out with, for instance, ultrafiltration or dialysis and gives the emulsion with the requested characteristics. Combining this concentration step together with the precipitation as described in JN-A 02.172.816 and JN-A 02.172.817 does not give the wanted results and leads to a tabular emulsion with thicker emulsion crystals.

OBJECTS OF THE INVENTION

It is therefore a first object of the invention to provide a method for preparing tabular silver halide crystals which are homogeneous.

It is a further subject of the present invention to provide a method for preparing tabular silver halide crystals which are homogeneous and thin.

It is even a further subject of the present invention to provide a method for preparing homogeneous and thin tabular silver halide crystals in a fast and efficient way.

It is also a subject of the present invention to provide a fast and efficient method for preparing a homogeneous and thin tabular silver halide emulsion in a concentrated form.

Further objects and advantages of the invention will become apparent from the description hereinafter.

SUMMARY OF THE INVENTION

The above mentioned objects can be accomplished by a method of preparing an emulsion of homogeneous and thin tabular silver halide crystals comprising the steps of:

(1) forming silver halide nuclei by simultaneously adding an aqueous silver salt and a halide salt solution to a reaction vessel (a), containing an aqueous solution of a protective colloid, (2) transferring the dispersion of silver halide nuclei formed in vessel (a) to a mixing chamber (b) and diluting said dispersion, (3) growing in a growth chamber (c) said nuclei of the diluted dispersion by adding and mixing an aqueous silver salt and a halide salt solution and collecting the grown crystals in reaction vessel (a) which is a part of a closed circuitry together with the mixing and growth chambers (b) and (c), (4) transferring said silver halide crystal dispersion to mixing chamber (b) and diluting the dispersion, (5) further growing the silver halide crystals in growth chamber (c) and collecting the silver halide crystals in reaction vessel (a), (6) concentrating the emulsion of silver halide crystals simultaneously with the step of growing in order to keep the emulsion level in reaction vessel (a) controlled.

DETAILED DESCRIPTION OF THE INVENTION

While the present invention will hereinafter be described in connection with preferred embodiments thereof, it will be understood that it is not intended to limit the invention to those embodiments. On the contrary, it is intended to cover all alternatives, modifications, and equivalents as may be included within the spirit and scope of the invention as defined by the appending claims.

By way of example and to make the description more clear, reference is made to the accompanying drawing, FIG. 1, which gives a schematic view of the method for preparing tabular silver halide crystals as used in the present invention. It shows the essential parts of the preparation system and their internal relationship which will be described hereinafter in detail.

This invention describes a method for the formation of silver halide crystals which are responsible for the photosensitivity of silver halide photographic material. These silver halide crystals can be prepared by mixing together a soluble silver and a soluble halide salt in the presence of a dispersing polymer as a binder. This procedure is normally carried out under well-defined circumstances of pH, pAg, temperature, flow rate profile of the reactant solutions, etc.. However the precipitation of a silver halide emulsion of the present invention has to be carried out by controlling the same parameters but in a new system configuration. This system is constituted out of a growth chamber (c) for the precipitation of silver halide crystals, a buffer vessel (a) for collecting the silver halide emulsion formed, a mixing chamber (b) for diluting the silver halide dispersion, a concentration unit (d) and some other small system units necessary for supporting the different system processes.

As shown in FIG. 1 the soluble silver salt ($Ag^+$) and soluble halide ($X^-$) solutions are stored in containers which are connected with the precipitation system via flow-controlled valves in order to regulate the amount of silver and halide which have to be supplied. These containers are directly connected to a main vessel (a) wherein both reactants can be added to form silver halide nuclei. In order to get a dispersion of the nuclei a protective colloid have to be preferably present in vessel (a) before starting the precipitation or can be simultaneously added together with both reactants. Principally many different protective colloids can be used which are described in Res.Disclosure, No.38957 (1996), section IIA. However the most preferred protective colloid which can be used in the present invention is gelatine that in turn can be mixed with a lot of other products that are compatible with gelatine and that improve the photographic quality, the film handling, convenience, etc. of the photosensitive materials containing said dispersion (see Res.Disclosure,No.38957 (1996), section IIC). The stability of the nuclei which are initially formed depends on the conditions that are used during the precipitation and the physical ripening which can take place.

In an alternative scheme the silver halide nuclei can be formed in growth chamber (c) before the transfer to vessel (a).

In a second alternative the silver halide nuclei can also be formed in an external nucleation unit before introduction in vessel (a) as described for instance in WO 90/01462, JN-A 05.341.414, JN-A 05.061.134.

In the next step following the preparation of the silver halide nuclei the dispersion of said nuclei is transferred from vessel (a) to a mixing chamber (b) wherein the dispersion is diluted by an aqueous solution. This aqueous solution is a regeneration product of the production process of the present invention as will be described later. The nuclei dispersion is diluted by adding between 0.2 and 10 parts of the aqueous solution mentioned hereinbefore per part of the dispersion. However this dilution factor is preferably situated between 0.3 and 5 and most preferably between 0.5 and 3. Mixing chamber (b) can be equipped with a special inlet system in order to optimize the mixing conditions or can even contain a special mixing device but such configurations for mixing chamber (b) are not necessary to give optimal results.

Further the diluted nuclei dispersion is transferred to a growth chamber (c) where silver halide is precipitated on the nuclei introduced from mixing chamber (b) via a silver salt and a halide salt inlet. While mixing in this chamber is very important additional arrangements can be taken to optimize the mixing efficiency. This can for instance be realized by improving the position of the silver salt and halide salt inlet or by positioning a special mixing device or arrangement.

In an alternative modification of the preparation method described in the present invention the growth of the diluted nuclei dispersion in chamber (c) can be executed by adding silver halide crystals formed in an external mixer or precipitating unit as for instance is described in WO 90/01462. The fine grains formed in this mixer have to be immediately introduced in growth chamber (c) because these grains dissolve readily due to their fineness of grain size to again form silver and halide ions which in turn deposit on the minute amount of nuclei introduced from the diluting unit (b). This way of working is interesting because of the possibility to form homogeneous crystals which are also uniform in halide composition. Mixing the different solutions coming together in growth chamber (c) is important in order to increase the homogeneity of the reaction mixture and to minimize the thickness growth.

The silver halide crystal dispersion formed in the growth chamber (c) is than transferred to vessel (a) before it is pumped to the next processing steps namely diluting and growing. The continuous production of the tabular silver halide dispersion coming from growth chamber (c) will increase the amount of dispersion and therefor the level of the dispersion in vessel (a). In order to keep the amount of dispersion within a given limit, vessel (a) is built in a closed circuitry together with an special unit (d) in which the dispersion can be concentrated. The most preferred way of concentrating the dispersion of the present invention is using an ultra-filtration or a dialysis unit. This ultra-filtration or dialysis unit is started automatically if the dispersion in vessel (a) is exceeding a certain restricted level which is detected by a float positioned in vessel (a) in order to keep the volume constant. The eluate coming from concentrating unit (d) can be collected in vessel (e) which in turn can be used for the dilution of the nuclei or crystal dispersion in mixing chamber (b). It have to be remembered that this eluate is containing the salts left after the precipitation of silver halide. A float in vessel (e) is controlling the amount of water and discharge the superfluous amount of aeoueous solution to a drain. The way the homogeneous thin tabular emulsions of the present invention is prepared, is quite different from the method used in JN-A 02.172.816 where the crystals formed in a growth chamber were first fed through an ultra-filtration unit before collection in a buffer vessel and transfer to the same growth-chamber. This can also be said for both systems described in JN-A 02.172.817 where together with the growth chamber a second mixing chamber is used. This second chamber is used to mix a dispersion of freshly prepared crystals together with a dispersion produced in an earlier production cycle which is first concentrated by ultra-filtration. The difference between the production systems described in the last mentioned Japanese patents and the system of the present invention is the fact that the formation of the crystals in the growth chamber is not executed on a diluted dispersion of silver halide crystals.

The concentration of the reactants used for the precipitation of the silver halide crystals in growth chamber (c) is not limited and can be as high as 5 or 6 mole per liter. A more preferred concentration range of the reactants can go up to 3 mole per liter.

By overlooking the several steps in the production of a homogeneous and thin tabular silver halide emulsion according to the present invention the following remark can be made. The silver halide dispersion can be continuously withdrawn out of vessel (a) during the continuously crystal production process for feeding the ultra-filtration unit where the prepared silver halide crystals are simultaneously separated from the soluble salts accumulated in (a) during crystal formation. The concentration of the silver halide in vessel (a) can increase during the preparation process of the present invention till 5 but it will be preferably situated between 0.1 and 4 and most preferably between 0.1 and 3 mole per liter.

The photographic emulsions prepared in this way for use in the image-forming element of the present invention can contain silver-halide crystals comprising chloride, bromide or iodide alone or combinations thereof. Other silver salts which can be incorporated into a limited amount in the silver halide lattice are silver phosphate, silver thiocyanate and some other silver salts including organic silver salts like silver citrate and others. The chloride and bromide salts can be combined in all ratios in order to form a silver chlorobromide salt. Iodide ions however can be coprecipitated with chloride and/or bromide ions in order to form a iodohalide with a iodide amount depending on the saturation limit of iodide in the lattice with the given halide composition; i.e. up to a maximum amount of about 40 mole % in silver iodobromide and up to at most 13 mole % in silver iodochloride both based on silver.

The composition of the silver halide in the crystal volume can change in a continuous or in a discontinuous way. Emulsions containing crystals composed of various sections with different halide compositions are used for several different photographic applications. Such a structure with a difference in halide composition between the centre and the rest of the crystal (known as so-called "core-shell" emulsion) or with more than two crystal parts differing in halide composition (called a "band" emulsion) may occur. The changes in halide composition can be realized by direct precipitation or in an indirect way by conversion wherein fine silver halide grains of a certain predetermined halide composition are dissolved in the presence of the so-called host grains forming a "shell" or "band" on the given grain.

The crystals formed by the methods described above have a morphology which can be described as tabular. In tabular crystals the aspect ratio (ratio of equivalent circular diameter to thickness) of the grains can vary from low (<2) over "medium" or "intermediate" (from 2 up to 8) to "high" (>8). The aspect ratio of the tabular silver halide crystals of the present invention is preferably >2. The thickness of the last mentioned emulsions can be very low and is preferably situated between 0.03 and 0.30 $\mu$m with a variation coefficient preferably <40% and most preferably between 0.07 and 0.22 $\mu$m with a variation coefficient of not more than 30%. Especially in the case of the ultra-thin tabular crystals of the present invention high aspect ratios can be realized. The major faces of the tabular grains may have a {111} or a {100}-habit, the structure of which is stable or should be stabilized (for instance by a "crystal habit modifying agent") respectively.

After precipitation in growth chamber (c) of the system of the present invention as described hereinbefore any excess of aqueous soluble salts can be removed via the concentration step where the emulsion is separated in an ultrafiltrating or dialysing system. It means that the emulsion produced in this way immediately can be used in the next step of the production process. Although less efficient in the precipitation system of the present invention the more classical methods of emulsion washing can also be used. All the procedures which can be used for removing any excess of salt without any problem, including the methods like the dia- or ultrafiltration and ion-exchange techniques, are described in Research Disclosure No. 38957(1996), section III. The silver halide emulsions of the present invention that are prepared in one of the ways described hereinbefore contain crystals having a spherical equivalent diameter (SED) of not more than 1.5 $\mu$m while the minimum spherical equivalent diameter is not less than 0.01 $\mu$m. The spherical equivalent diameter (SED) of the crystal represents the diameter of the sphere having the same volume as the average volume of the silver halide crystals of said emulsion.

The silver halide emulsions can be chemically sensitized in many different ways. It can be carried out in the presence of a chalcogen as sulphur, selenium or tellurium, in the presence of a noble metal as e.g. gold or in combination with a chalcogen and noble metal. Sometimes it can be necessary to add a sulphur sensitizer in the form of a dispersion of solid particles as described in EP-A 0 752 614. Reduction sensitization is another method of sensitizing a photosensitive silver halide emulsion that can be combined with the chalcogen/noble metal sensitization if desired. Reduction sensitization should be mentioned as a way of introducing hole traps into the silver halide crystals for use in the image-forming elements according to the present invention in order to optimize the efficiency of latent image formation. It is clear that the incorporation of hole traps into silver halide can also be realized in other ways e.g. by the introduction of $Cu^{(+)}$, $Ni^{(2+)}$, etc.. Reduction sensitization can be performed by decreasing the pAg of the emulsion or by adding thereto reducing agents as e.g. tin compounds (see GB-Patent 789,823), amines, hydrazine derivatives, formamidine-sulphinic acids, silane compounds, ascorbic acid, reductic acid and the like. Care should however be taken in order to avoid generation of fog in an uncontrollable way. Certain "modifying agents" that can optimize the chemical sensitization process are often used. A complete description of all the different possibilities with respect to this subject can be found in Research Disclosure No. 38967 (1996), section IV.

In a next step the silver halide emulsions used in the image-forming elements according to the present invention are spectrally sensitized with dyes from different classes which include polymethine dyes comprising cyanines, merocyanines, tri- tetra- and polynuclear cyanines and merocyanines, oxonols, hemioxonols, styryls, merostyryls, etc.. Sometimes more than one spectral sensitizer may be used in case a larger part of the spectrum should be covered. Combinations of several spectral sensitizers are sometimes used to get supersensitization, meaning that in a certain region of the spectrum the sensitization is greater than that from any concentration of one of the dyes alone or that which would result from the additive effect of the dyes. Generally supersensitization can be attained by using selected combinations of spectral sensitizing dyes and other addenda such as stabilizers, development accelerators or inhibitors, brighteners, coating aids, etc.. A good description of all the possibilities in spectral sensitization that is important with respect to this invention can be found in Research Disclosure No. 38957(1996), section V. In case desensitizers should be used, as for instance in pre-fogged direct-positive or in daylight handling materials, various chemical compounds are proposed for practical use. Principally all the compounds being used as desensitizers in silver halide materials and being for instance summarized in EP-A 0 477 436 can be used in combination with the elements of the present invention.

The photographic elements comprising said silver halide emulsions may include various compounds which should play a role of interest in the material itself or afterwards as e.g. in processing, finishing or storing the photographic material. These products are summarized in the following table.

The silver halide material can also contain different types of couplers that can be incorpated as described in the same Res.Disclosure, section X.

The photographic elements can be coated on a variety of supports as described in Res.Disclosure,No. 38957(1996), section XV, and the references cited therein.

| Additive | Res. Discl., 38957 (1996) |
|---|---|
| stabilizers and anti-foggants | section VII |
| hardeners | section IIB |
| brighteners | section VI |
| light absorbers and scattering materials | section VIII |
| coating aids | section IXA |
| antistatic agents | section IXC |
| matting agents | section IXD |
| development modifiers | section XVIII |

The photographic elements may be exposed to actinic radiation, especially in the visible, near-ultraviolet and near-infrared region of the spectrum, in order to form a latent image (see Res.Disclosure, No.38957(1996) section XVI). For some applications the irradiation of the doped material with X-rays is also part of the present invention. The latent-image formed can be processed in many different ways in order to form a visible image as described in Res.Disclosure, No.38957(1996), section XIX.

The present invention is also especially focusing on automatic processing photosensitive silver halide materials, which is advantageously used in order to get rapid and convenient processing. In order to prevent the disadvantages of automatic processing (as e.g. the formation of silver sludge) the materials of the present invention can preferably be processed as described in EP-A 0 732 619. The developer mentioned in the last reference contains a combination of hydroquinone and ascorbic acid or one of its isomers or derivatives as an auxiliary developing agent. In more general terms this has already been described for silver halide systems as those mentioned e.g. in EP-A 0 552 650 and EP-A 0 752 614, but it is recommended to apply the method and to use the various ascorbic acid analogues as described in EP-A 0 732 619.

Processing to form a visible dye image for colour materials means contacting the element with a colour developing agent in order to reduce developable silver halide and to oxidize the colour developing agent which in turn normally reacts with a coupler to form a dye. This application is extensively described in Res. Disclosure, No. 38957(1996), section XX.

Special attention should be paid to the photothermographic application which is also an important part of the present invention. In this type of materials a photosensitive agent is present which after exposure to UV, visible or IR light is capable of catalysing or participating in a thermographic process bringing about changes in optical density or colour. Examples of photothermographic materials are the so called "Dry Silver" photographic materials of the 3M Company, which are reviewed by D. A. Morgan in "Handbook of Imaging Science", edited by A. R. Diamond, page 43, published by Marcel Dekker in 1991.

The photo-addressable thermosensitive element comprises photosensitive silver halide, a reducing agent for silver ions and a binder. The thermosensitive element may further comprise a substantially light-insensitive organic silver salt in catalytic association with the photosensitive silver halide and in thermal working relationship with the reducing agent for silver ions. The element may comprise a layer system with the silver halide in catalytic association with the substantially light-insensitive organic silver salt ingredients, a spectral sensitiser optionally together with a supersensitiser in intimate sensitising association with the silver halide particles and the other ingredients active in the thermal development process or pre- or post-development stabilization of the element being in the same layer or in other layers with the proviso that the organic reducing agent and the toning agent, if present, are in thermal working relationship with the substantially light-insensitive organic silver salt, i-e. during the thermal development process the reducing agent and the toning agent, if present, are able to diffuse to the substantially light-insensitive organic silver salt, e.g. a silver salt of a fatty acid. It is the purpose of the present invention to provide a photo-sensitive image-forming element, wherein said element is a photo-addressable thermographic element, comprising a substantially light-insensitive organic silver salt, an organic reducing agent therefor in thermal working relationship therewith and a binder.

If the photosensitive silver halide grains of the present invention described hereinbefoee are employed together with a substantially light-insensitive organic silver salt it is used in a range of 0.1 to 90 mole percent of substantially light-insensitive organic silver salt, preferably in the range from 0.2 to 50 mole percent, more preferably from 0.5 to 35 mole percent and most preferably in the range from 1 to 12 mole percent of said subtantially light-insensitive organic silver. Preferred substantially light-insensitive organic silver salts are silver salts of organic carboxylic acids in particular aliphatic carboxylic acids known as fatty acids wherein the aliphatic carbon chain has preferably at least 12 C-atoms, e.g. silver laurate, silver palmitate, silver stearate, silver hydroxystearate, silver oleate and silver behenate, which silver salts are also called "silver soaps", silver dodecyl sulphonate described in U.S. Pat. No. 4,504,575 and silver di-(2-ethylhexyl)-sulfosuccinate described in EP-A 0 227 141. Modified aliphatic carboxylic acids with thioether groups as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

A suspension of particles containing a substantially light-insensitive organic silver salt may be obtained by using a process comprising simultaneously metered addition of an aqueous solution or suspension of an organic carboxylic acid or its salt and an aqueous solution of a silver salt to an aqueous liquid as described in EP-A 0 754 969.

The silver halide emulsion grains described hereinbefore may be added to the photo-addressable thermally developable element in any way which places it in catalytic proximity to the substantially light-insensitive organic silver salt. Silver halide and the substantially light-insensitive organic silver salt being separately formed (i.e. ex-situ or "preformed") in a binder can be mixed prior to use to prepare a coating solution, but it is also effective to blend both of them for a long period of time which is especially important in cases where tabular silver halide grains are present so that an intimate contact with the large specific surface of said tabular grains is realized. Furthermore, it is effective to use a process which comprises addingia halogen-containing-compound to the organic silver salt to partially convert the substantially light-insensitive organic silver salt into silver halide as disclosed in U.S. Pat. No. 3,457,075.

A particularly preferred mode of preparing the emulsion of organic silver salt and photosensitive silver halide for coating the photo-addressable thermally developable element from solvent media according to the present invention is disclosed in U.S. Pat. No. 3,839,049, but other methods such as those described in Research Disclosure, June 1978, item 17029 and U.S. Pat. No. 3,700,458 may also be used for producing the emulsion. Another particularly preferred mode of preparing the emulsion of organic silver salt and photosensitive silver halide for coating the photo-addressable thermally developable element from aqueous media according to the present invention is disclosed in WO97/48014, which discloses a production method for a photothermographic recording material comprising the steps of: (i) providing a support; (ii) coating the support with a photo-addressable thermally developable element comprising a substantially light-insensitive organic silver salt, photosensitive silver halide in catalytic association with the substantially light-insensitive organic silver salt, a reducing agent in thermal working relationship with the substantially light-insensitive organic silver salt and a binder, characterised in that the photosensitive silver halide is formed by reacting an aqueous emulsion of particles of the substantially light-insensitive organic silver salt with at least one onium salt with halide or polyhalide anion(s) and that the photo-addressable thermally developable element is coated from an aqueous dispersion medium.

Suitable organic reducing agents for the reduction of the substantially light-insensitive organic silver salts in photo-addressable thermosensitive elements are organic compounds containing at least one active hydrogen atom linked to O, N or C, such as is the case with mono-, bis-, tris- or tetrakis-phenols, mono- or bis-naphthols, di- or polyhydroxy-naphthalenes, di- or polyhydroxybenzenes, hydroxymonoethers such as alkoxynaphthols, e.g. 4-methoxy-1-naphthol described in U.S. Pat. No. 3,094,41; pyrazolidin-3-one type reducing agents, e.g. PHENIDONE (tradename), pyrazolin-5-ones, indan-1,3-dione derivatives, hydroxytetrone acids, hydroxytetronimides, 3-pyrazolines, pyrazolones, reducing saccharides, aminophenols e.g. METOL (tradename), p-phenylenediamines, hydroxylamine derivatives such as for example described in U.S. Pat. No. 4,082,901, reductones e.g. ascorbic acids, hydroxamic acids, hydrazine derivatives, amidoximes, n-hydroxyureas and the like; see also U.S. Pat. No. A 3,074,809, U.S. Pat. No. 3,080,254, U.S. Pat. No. 3,094,417 and U.S. Pat. No. 3,887,378. Polyphenols such as the bisphenols used in the 3M Dry Silver™ materials, sulfonamide phenols such as used in the Kodak Dacomatic™ materials, and naphthols are particularly preferred for photothermographic recording materials with photo-addressable thermally developable elements on the basis of photosensitive silver halide/organic silver salt/reducing agent. During the thermal development process the reducing agent must be present in such a way that it is able to diffuse to the photosensitive silver halide and, if present, the substantially light-insensitive organic silver salt particles so that reduction thereof can take place.

The above mentioned reducing agents, regarded as primary or main reducing agents, may be used in conjunction with so-called auxiliary reducing agents. Auxiliary reducing agents that may be used in conjunction with the above mentioned primary reducing agents are sulfonyl hydrazide reducing agents such as disclosed in U.S. Pat. No. 5,464,738, trityl hydrazides and formyl-phenyl-hydrazides such as disclosed in U.S. Pat. No. 5,496,695 and organic reducing metal salts, e.g. stannous stearate described in U.S. Pat. Nos. 3,460,946 and 3,547,648.

The film-forming binder for the photo-addressable thermosensitive element according to the present invention may be coatable from a solvent or aqueous dispersion medium. In case the film-forming binder for the photo-addressable thermosensitive element is coatable from a solvent dispersion medium according to the present invention, all kinds of natural, modified, natural or synthetic resins or mixtures of such resins in which the organic silver salt can be dispersed homogeneously may be used; e.g. polymers derived from a,b-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof. A particularly suitable polyvinyl butyral containing a minor amount of vinyl alcohol units is marketed by MONSANTO U.S.A. under the trade names BUTVAR™ B76 and BUTVAR™ B79 and provides a good adhesion to paper and properly subbed polyester supports. The film-forming binder for the photo-addressable thermosensitive developable element coatable from an aqueous dispersion medium according to the present invention may be all kinds of transparent or translucent water-dispersible or water soluble natural, modified natural or synthetic resins or mixtures of such resins in which the organic silver salt can be dispersed homogeneously, for example proteins such as gelatin and gelatin derivatives (e.g. phthaloyl gela-tin), cellulose derivatives such as carboxymethylcellulose, polysaccharides such as dextran, starch ethers, galactomannan, polyvinyl alcohol, polyvinylpyrrolidone, acrylamide polymers, homo- or copolymerized acrylic or methacrylic acid, latexes of water dispersible polymers, with or without hydrophilic groups, or mixtures thereof. Polymers with hydrophilic functionality for forming an aqueous polymer dispersion (latex) are described in U.S. Pat. No. 5,006,453., but serve therein for forming a barrier layer preventing unwanted diffusion of vanadium pentoxide present as an antistatic agent.

The binder to organic silver salt weight ratio is preferably in the range of 0.2 to 6, while the thickness of the photo-addressable thermally developable element is preferably in the range of 5 to 50 $\mu$m.

The above mentioned binders or mixtures thereof may be used in conjunction with waxes or "heat solvents", also called "thermal solvents" or "thermosolvents", improving the reaction speed of the redox-reaction at elevated temperature. By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic silver salt, at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1,1-dioxide, methyl anisate and 1,10-decanediol being described as heat solvents in Research Disclosure, December 1976, (item 15027) pages 26–28. Still other examples of heat solvents have been described in U.S. Pat. 3,438,776, and 4,740,446, and in published EP-A 0 119 615 and 0 122 512 and DE-A 3 339 810.

The photo-addressable thermosensitive material comprising said substantially light-insensitive organic silver salt and said light-sensitive silver halide crystals may include various other compounds which should play a role of interest in the material itself or afterwards as e.g. in the processing, finishing or conservation stage of the material. These compounds can be 'toning agents', also stabilizers and antifoggants, surfactants (specially for coating photo-addressable thermosensitive elements from aqueous media), anti-halation dyes and other additives (like free fatty acids, antistatic agents, surface active agents, etc.) that are described in EP-A 0 844 514. The support used for the photo-addressable thermosensitive material, the function and composition of the protective and antistatic layers, the coating of the various layers of the photothermographic recording material are also disclosed in EP-A 0 844 514.

The invention is further described and illustrated by way of the following examples.

EXAMPLES

Comparative Emulsion 1

A reaction vessel having a volume of 6 liter was filled with 1500 ml of demineralized water, further adding thereto 14.2 ml of a solution of sulphuric acid 6 N (in order to get a starting pH of 1.7), 6.8 ml of an aqueous solution of potassium bromide 2.94 N (in order to provide a potential difference between a silver electrode and a silver/silver chloride reference electrode of 6 mV. At a temperature of 40° C. an amount of 7.5 g of oxidized gelatine (having less than 40 ppm of methionin.

Silver halide nuclei were formed by reaction of a silver nitrate solution and a halide salt solution run by double-jet in the reaction vessel at a rate of 80 ml/min. at 40° C. and at 40 mV during 9 seconds.

After a physical ripening time of 25 minutes, during which the temperature of the reaction vessel was increased up to 70° C.

After another 2 minutes of physical ripening 50 g of inert gelatin was added.

In order to get homogenization of the reaction mixture in the reaction vessel and a steady-state with respect to the thereto coupled ultrafiltration unit, ultrafiltration was started during 8 minutes, one minute after addition of said inert gelatin while the volume was kept constant at 2000 ml.

Before growing the silver halide nuclei potassium bromide was added at a rate of 7.5 ml per minute during 85 seconds.

After this neutralization reaction whereby the potential was decreased to +30 mV, silver halide emulsion crystals were grown at the same potential value by increasing the double jet precipitation rate up from 5 ml/min. up to 33.4 ml/min. during 7587 seconds for the silver nitrate solution, while continuously adapting the running velocity of the halide salt solution in order to have a constant potential value of +30 mV. A total amount of 500 g of silver nitrate was thus precipitated.

Following data after measuring the silver halide crystals on photographs obtained by electron microscopic techniques (surface measurements) and by equivalent volume measurements by reduction of individual grains by electrochemical techniques, were obtained at the end of precipitation:

average equivalent volume crystal diameter d: 0.57 $\mu$m variation coefficient on d: 0.28 equivalent circular diameter: 1.26 $\mu$m average thickness of tabular crystals: 0.19 $\mu$m average aspect ratio: 6.4 tabularity (aspect ratio: thickness): 34

Comparative Emulsion 2

Same emulsion as Comparative Emulsion 1 was prepared, except for a starting volume in the reaction vessel of 2915 ml instead of 1500 ml. An amount of potasium bromide of 8.6 ml of potassium bromide was added instead of 6.8. The addition rate of silver nitrate solution during growth was increased from 5 up to 33.4 ml/min. and the ultrafiltration volume was 3333 ml (only 0.3 l of the silver nitrate solution 2.94 N per liter of aqueous solution in the reaction vessel).

Tabular silver halide emulsion crystal characteristics are following:

average equivalent volume crystal diameter d: 0.56 μm variation coefficient on d: 0.21 equivalent circular diameter: 1.03 μm average thickness of tabular crystals: 0.17 μm average aspect ratio: 6.0 tabularity (aspect ratio:thickness): 35

These data are illustrative for the (relative small) effect of dilution of the reaction vessel on tabularity: a procentually larger effect on thickness is observed (0.17 μm instead of 0.19 μm).

Inventive Emulsion 1

Same emulsion as Comparative Emulsion 1 was prepared, except for diluting the emulsion in an external vessel with water in order to reduce the emulsion concentration in the said external vessel by addition of the same volume of demineralized water (dilution factor=1:1).

Tabular silver halide emulsion crystal characteristics are following:

average equivalent volume crystal diameter d: 0.47 μm variation coefficient on d: 0.28 equivalent circular diameter: 1.47 μm average thickness of tabular crystals: 0.13 μm average aspect ratio: 11.6 tabularity (aspect ratio: thickness): 89

These data are illustrative for the effect of local dilution of silver halide emulsion crystals: thickness growth is clearly avoided.

Inventive Emulsion 2

Same emulsion as Comparative Emulsion 1 was prepared, except for diluting the emulsion in an external vessel with water in order to reduce the emulsion concentration in the said external vessel by addition of 2.5 times the same volume of demineralized water (dilution factor=volume of demineralized water: volume of emulsion=5:2).

Tabular silver halide emulsion crystal characteristics are following:

average equivalent volume crystal diameter d: 0.53 μm variation coefficient on d: 0.26 equivalent circular diameter: 1.31 μm average thickness of tabular crystals: 0.11 μm average aspect ratio: 11.8 tabularity (aspect ratio:thickness): 107

These data are illustrative for the effect of further local dilution of silver halide emulsion crystals: thickness growth is clearly more avoided in case of further dilution. The tabularity value strongly increases.

Inventive Emulsion 3

Same emulsion as Inventive Emulsion 1 was prepared, except for the potential at which the silver halide nuclei were grown, said potential being +50 mV instead of +30 mV.

Tabular silver halide emulsion crystal characteristics are following:

average equivalent volume crystal diameter d: 0.50 μm variation coefficient on d: 0.06 equivalent circular diameter: 1.18 μm average thickness of tabular crystals: 0.14 μm average aspect ratio: 8.3 tabularity (aspect ratio: thickness): 59

These data are illustrative for the improved homogeneity of the main population of tabular silver halide crystals.

Combination of enhanced potential values during growth and emulsion dilution in an external vessel clearly leads to less thickness growth than in the absence of said local dilution (experimentally, expressed per increased mV this was only 0.75 instead of 2 nm in case of a dilution as in this inventive example).

Having described in detail preferred embodiments of the current invention, it will now be apparent to those skilled in the art that numerous modifications can be made therein without departing from the scope of the invention as defined in the appending claims.

What is claimed is:

1. Method of preparing a photosensitive element containing a silver halide emulsion with homogeneous and thin tabular crystals having an aspect ratio of at least 2, a thickness between 0.07 and 0.22 μm and a variation coefficient of not more than 30%, comprising the steps of:

(1) forming silver halide nuclei by simultaneously adding an aqueous silver salt and a halide salt solution to a reaction vessel (a), containing an aqueous solution of a protective colloid, (2) transferring the dispersion of silver halide nuclei formed in vessel (a) to a mixing chamber (b) and diluting said dispersion, (3) growing in a growth chamber (c) at a controlled potential value said nuclei of the diluted dispersion by adding and mixing an aqueous silver salt and a halide salt solution and collecting the grown crystals in reaction vessel (a) which is a part of a closed circuitry together with the mixing and growth chambers (b) and (c), (4) transferring said silver halide crystal dispersion to mixing chamber (b) and diluting the dispersion, (5) further growing the silver halide crystals in growth chamber (c) at a controlled potential value and collecting the silver halide crystals in reaction vessel (a), (6) concentrating the emulsion of silver halide crystals simultaneously with the step of growing in order to keep the emulsion level in reaction vessel (a) controlled;

wherein the steps of growing proceed at an enhanced potential value (expressed in mV) during growth as compared to during forming said silver halide nuclei, said enhanced potential value being chosen as a function of emulsion dilution, with a dilution factor expressed as volume of demineralized water:volume of emulsion, to obtain less thickness growth (expressed in nm/mV) than in an absence of dilution.

2. Method according to claim 1, wherein the protective colloid is gelatine.

3. Method according to claim 1, wherein the factor of diluting is situated between 0.2 and 10.

4. Method according to claim 1, wherein the step of diluting is carried out with water recovered during the step of concentrating the emulsion.

5. Method according to claim 1, wherein said step of concentrating is carried out by ultrafiltration or dialysis.

6. Method according to claim 1, wherein the concentration of silver in vessel (a) during the steps (3) up to (6) of the preparation process of said tabular silver halide crystals is held between 0.1 and 5 mole per liter.

7. Method according to claim 1, with the modification that the silver halide nuclei are initially formed in the growth chamber (c) before collecting them in the protective colloid solution in reaction vessel (a).

8. Method according to claim 1, wherein said silver halide crystals have a mean spherical equivalent diameter SED situated between 0.01 and 1.50 $\mu$m.

9. A photosensitive element prepared according to the method of claim 1, wherein said element is a photoadressable thermographic element, further comprising a substantially light-insensitive organic silver salt, an organic reducing agent therefor in thermal working relationship therewith and a binder.

10. Method according to claim 1, wherein said thickness growth is 0.75 nm/mV when the dilution factor is 1:1 instead of 2 nm/mV as in the absence of dilution.

* * * * *

UNITED STATES PATENT AND TRADEMARK OFFICE

CERTIFICATE OF CORRECTION

PATENT NO. : 6,214,532 B1
DATED : April 10, 2001
INVENTOR(S) : Dirk Bollen

It is certified that error appears in the above-identified patent and that said Letters Patent is hereby corrected as shown below:

Title page,
Item [57] ABSTRACT,
Line 9, "chaiber" should read -- chamber --.

Column 1,
Line 22, "colloid-" should read -- colloid. --

Column 5,
Line 28, "aeoueous" should read -- aequeous --.

Column 6,
Line 34, "<40%" should read -- ≤40% --.

Column 7,
Line 23, "38967" should read -- 38957 --.
Line 29, "tri- tetra-" should read -- tri-, tetra- --.

Column 9,
Line 5, "i-e." should read -- i.e. --.
Line 16, "herebefoee" should read -- herebefore --.
Line 58, "addingia" should read -- adding a --.
Line 59, "halogen-containing-compound" should read -- halogen-containing compound --.

Column 11,
Line 35, "U.S. Pat. No. 5,006,453" should read -- U.S. Pat. No. 5,006,451 --.
Line 49, "50° C." should read -- 50° C --.

UNITED STATES PATENT AND TRADEMARK OFFICE

CERTIFICATE OF CORRECTION

PATENT NO. : 6,214,532 B1
DATED : April 10, 2001
INVENTOR(S) : Dirk Bollen

It is certified that error appears in the above-identified patent and that said Letters Patent is hereby corrected as shown below:

Column 12,
Line 28, "C." should read -- C --.
Line 32, "40° C." should read -- 40° C --.

Signed and Sealed this

Eighth Day of January, 2002

*Attest:*

*Attesting Officer*

JAMES E. ROGAN
*Director of the United States Patent and Trademark Office*